United States Patent [19]

George

[11] Patent Number: 4,865,477

[45] Date of Patent: Sep. 12, 1989

[54] CONTINUOUS FORM CARRIER CARD SEPARATOR

[75] Inventor: Craig A. George, Rochester, N.Y.

[73] Assignee: Eastman Kodak Company, Rochester, N.Y.

[21] Appl. No.: 292,689

[22] Filed: Jan. 3, 1989

[51] Int. Cl.[4] ..... B41J 13/12

[52] U.S. Cl. ..... 400/531; 400/622; 282/11.5 A; 209/656; 209/699

[58] Field of Search ..... 400/531, 537, 538, 611, 400/622, 619; 282/11.5 R, 11.5 A; 229/69, 68; 225/100; 209/606, 631, 635, 638, 656, 689, 695, 698, 699, 701

[56] References Cited

U.S. PATENT DOCUMENTS

| | | | |
|---|---|---|---|
| 3,484,097 | 12/1969 | Jory | 270/52 |
| 3,704,015 | 11/1972 | Holovka, Jr. et al. | 270/52 |
| 3,804,226 | 4/1974 | Ellis | 400/531 |
| 3,879,028 | 4/1975 | Frank | 270/52 |
| 4,285,433 | 8/1981 | Garrett, Sr. et al. | 209/606 |
| 4,515,490 | 5/1985 | Marker, III | 270/52 |
| 4,529,227 | 7/1985 | Fields | 270/52 |
| 4,636,099 | 1/1987 | Goldstone | 400/622 |
| 4,708,503 | 11/1987 | Poor | 400/622 |

OTHER PUBLICATIONS

"Automatic Label Dispenser for Matrix Printers" IBM Tech. Discl. Bulletin, vol. 24, No. 8, Jan. 1982, pp. 4384–4385.

"Diskette Labeler" IBM Tech. Discl. Bulletin, vol. 29, No. 6, 1986, pp. 2413–2414.

*Primary Examiner*—Eugene H. Eickholt

*Attorney, Agent, or Firm*—Armin B. Pagel

[57] ABSTRACT

An electronic printer using edge-perforated continuous-form paper is adapted to print and sequentially stack cards that are initially carried by a paper carrier sheet corresponding to continuous-form paper. The printer includes paper tractor means above the printing means for feeding the paper upwardly past the printing means. A card separating attachment includes another paper driving device above the tractor means for drawing the paper carrier rearwardly over a separator bar. This separates the carrier paper from the cards, which are guided by guide means so that they fall face downwardly into a receptacle, thereby providing a stack of cards arranged in the order in which they were printed.

6 Claims, 4 Drawing Sheets

CONTINUOUS FORM CARRIER CARD SEPARATOR

BACKGROUND OF THE INVENTION

1. Field Of The Invention

The present invention relates to means for adapting a continuous-form printer for printing sequential sets of cards initially carried by a continuous-form paper carrier sheet.

2. Brief Description Of The Prior Art

Many electronic printers are designed to use so-called continuous-form paper, which is a continuous strip of paper provided along each edge with sprocket perforations. The paper is initially stacked by being folded in alternate directions along perforated tear lines and similar perforated lines are provided along both edges to allow the sprocket hole margins of the paper to be torn away. In the type of printer to which the present invention is directed, the continuous-form paper is fed upwardly past the printing means by so-called tractor units that engage the sprocket holes along both edges of the paper above the printing means. Various types of printing means can be employed in such a printer, e.g. dot matrix, hammerbar, daisy wheel, thermal, ink jet, etc.

In many cases, there is a need to print information on individual cards and to arrange the cards in sequential order. For example, printed tabulating cards, that are both visually readable and machine readable, are now replacing punch cards in many applications where punch cards were formerly widely employed. The concept of providing cards or labels removably attached to a carrier strip by which they can be fed through a printer is known in the art, but simply using this concept in conjunction with a conventional continuous-form electronic printer requires that the printed cards be manually separated from the carrier sheet and stacked, which is laborious and inefficient. It is also known to remove cards or labels from a carrier sheet by drawing the latter around a bar of smaller radius than can be accommodated by the relatively stiff cards or labels but this concept has previously been used in a separate apparatus such as a label applying machine, rather than being incorporated into a printer.

SUMMARY OF THE INVENTION

In accordance with the present invention, an electronic printer using edge-perforated continuous-form paper is adapted to print and sequentially stack cards that are initially carried by a paper carrier sheet corresponding to continuous-form paper. The printer includes paper tractor means above the printing means for feeding the paper upwardly past the printing means. A card separating attachment includes another paper driving device above the tractor means for drawing the paper carrier rearwardly over a separator bar. This separates the carrier paper from the cards, which are guided by guide means so that they fall face downwardly into a receptacle, thereby providing a stack of cards arranged in the order in which they were printed.

Various means for practicing the invention and other advantages and novel features thereof will be apparent from the following detailed description of the illustrative drawings.

DESCRIPTION OF THE ILLUSTRATIVE PREFERRED EMBODIMENTS

Figure 1:
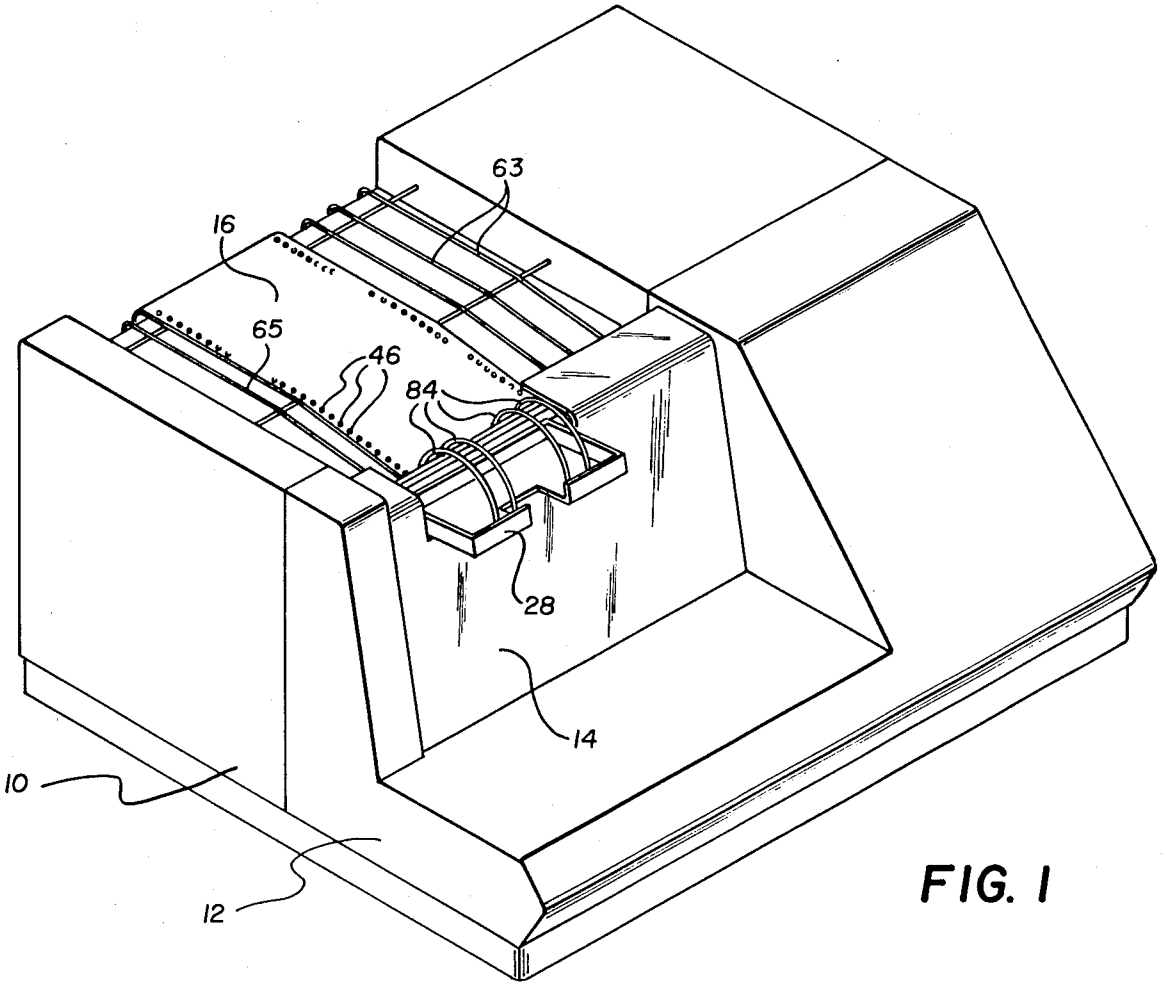
FIG. 1 is a perspective view of an illustrative printer embodying a card separate device according to the present invention.
Figure 2:
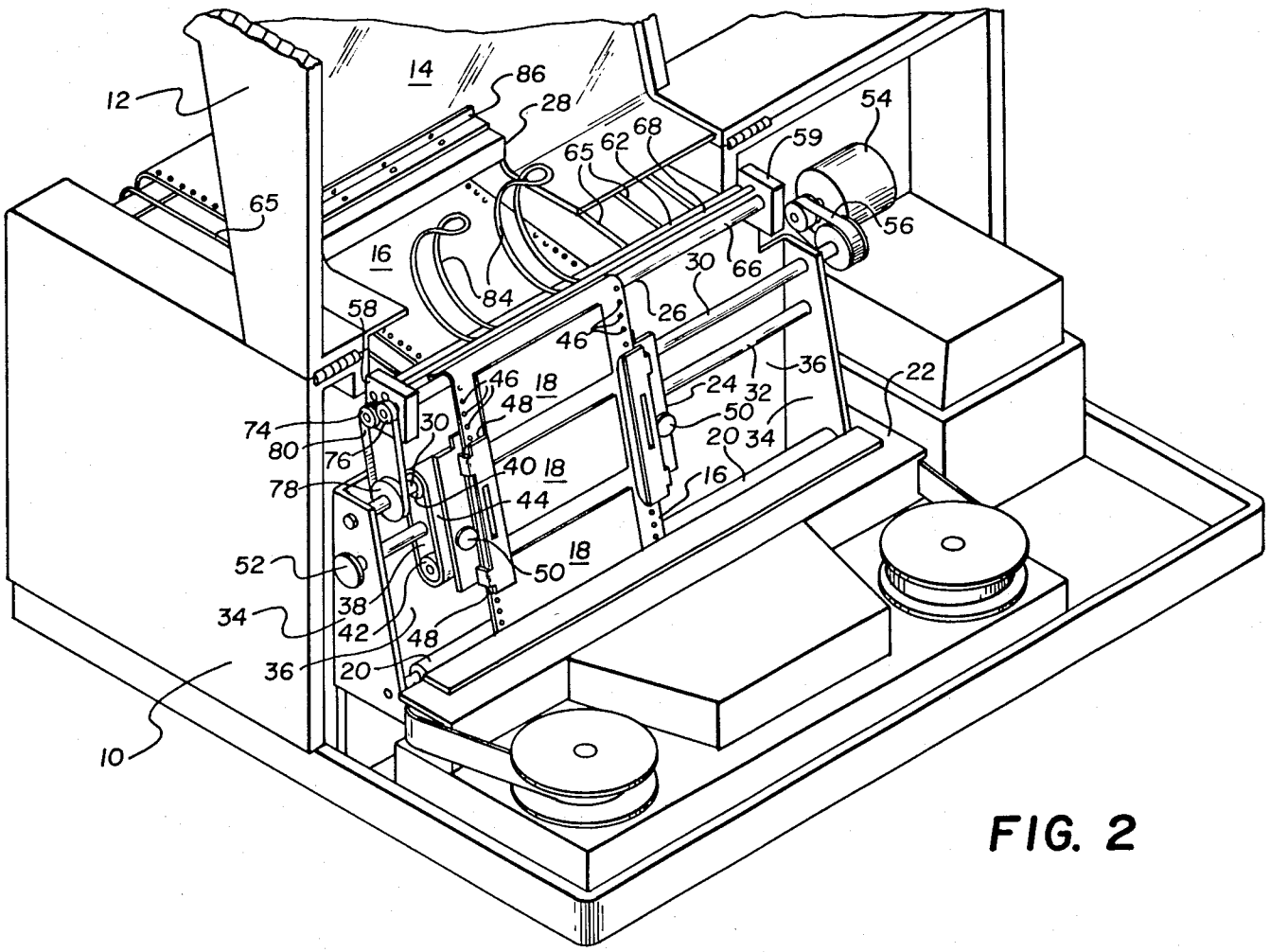
FIG. 2 corresponds to FIG. 1 but shows the illustrative printer with its cover in an open position.
Figure 3:
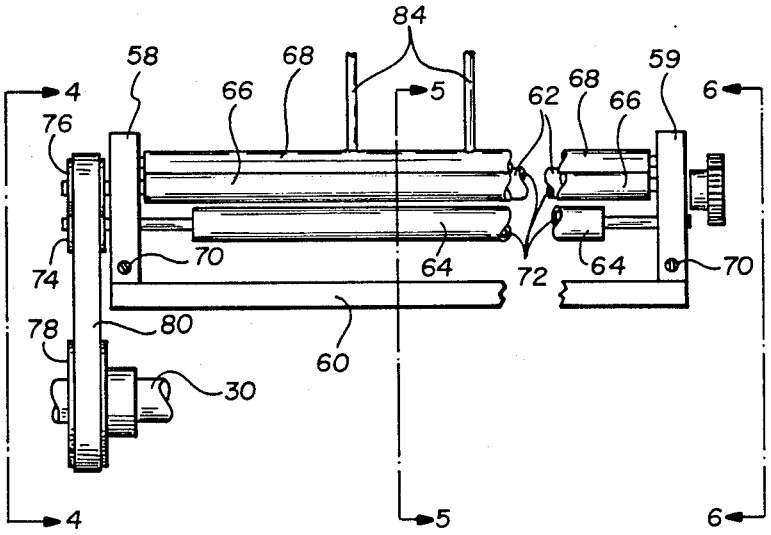
FIG. 3 is a somewhat schematic fragmentary front view of the roller assembly incorporated in the printer shown in FIGS. 1 and 2.

FIGS. 1 and 2 are somewhat simplified perspective illustrations of the present invention incorporated in an electronic printer similar to the general type designated as P-series Printonix printers, sold by Printronix Inc., Irvine, Calif. The printer comprises a housing 10 provided with a hinged cover member 12 including a transparent window member 14. A carrier strip 16 similar to continuous-form paper but carrying separable cards 18 is fed into the printer from a supply box located below the printer, and passes between a roller platen 20 and a so-called hammerbar printer device 22 located directly in front of the roller platen. The carrier strip is received along its margins in tractor units 24 that employ toothed belts in engagement with the marginal sprocket holes in the paper to move the paper upwardly through the printer. The components added to the commercially available electronic printer by the present invention are the separator unit 26 and the card receptacle unit 28, which will be described later in greater detail.

The two tractor units 24 are supported on parallel shafts 30 and 32. The upper splined shaft 30 is rotatably carried in bearings in flange plates 34 extending forwardly from vertical support plate 36. The lower support shaft 32 is likewise supported between flange plates 34 and is axially movable but is not necessarily rotatable. Each tractor unit includes a frame 38 rotatably supporting two sprocket wheels 40 and 42 surrounded by a tractor belt 44 provided with internal driving sprocket teeth and with external sprocket pins that engage the marginal sprocket holes 46 of the continuous-form paper or the similar card support paper. The paper is maintained in engagement with the external belt teeth by a slotted guide shoe 48 that can be hinged aside to permit threading the paper through the tractor units. The upper sprocket wheel 40 of each tractor unit is internally splined and is carried by splined shaft 30. Support shaft 32 extends through corresponding holes in the tractor unit frames, which are provided with locking screws 50 or the like to allow the tractor units to be adjusted along rods 30 and 32. An adjusting wheel 52 at the end of support shaft 32 allows that shaft to be moved slightly axially, to adjust both tractor units laterally in unison. A stepper motor 54 is connected to a splined shaft 30 by a toothed timing belt 56 to drive the tractor units in synchronism with other operations of the printer to advance the paper incrementally upwardly past the printing unit.

Figure 4:
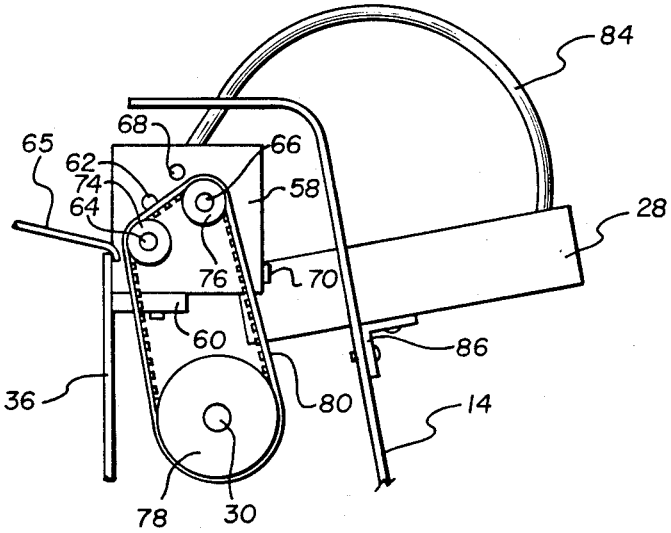
FIG. 4 is a view of the essential elements of the card separate structure taken along line 4—4 of FIG. 3.

The separator unit 26, best shown in FIGS. 3 through 6, comprises two bearing plates 58 and 59 connected together by a rectangular bar 60 that holds the separator until together as a unitary assembly. The bearing plates are provided with appropriate bearings to rotatably support upper and lower roller shafts 62 and 64, separator shaft 66 and guide finger shaft 68 in parallel relation to each other. Screws 70 extend through the bearing plates 58 and 59 into vertical support plate 36 to support the separator unit in the printer. As best shown in FIG. 4, the separator shaft 66 is a smooth cylindrical shaft located forwardly of the two roller shafts, which are provided with resilient sleeves or coatings 72 of rubber or the like. As best shown in FIG. 4, the lower roller shaft and the separator shaft are provided with respective gear belt pulleys 74 and 76, by which they are driven from a larger gear pulley 78 on splined shaft 30 by internally toothed gear belt 80. At the opposite end of the separator unit, shown in FIG. 6, the upper roller shaft is connected to the separator shaft by spur gears 82. Accordingly, as viewed in FIG. 3 or 4, the counterclockwise rotation of splined shaft 30, which drives the tractor units, causes the lower roller shaft 64 and the separator shaft 66 to rotate counterclockwise while the upper roller shaft 62 rotates clockwise with the same peripheral velocity as the lower roller shaft. Pulleys 74 and 76 are the same size, as are gears 82 but pulley 78 is larger than pulleys 74 and 76 so that the peripheral velocity of the roller shafts is slightly greater than the velocity of the paper engaging portions of the tractor belt units.

Figure 5:
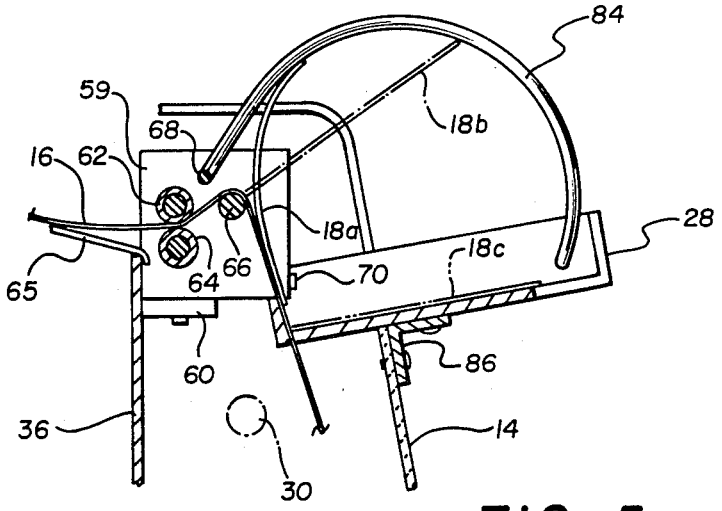
FIG. 5 is a view taken along lines 5—5 of FIG. 3.
Figure 6:
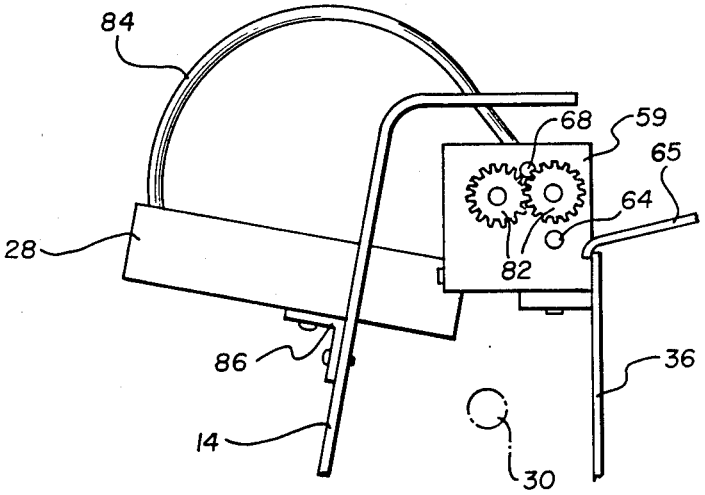
FIG. 6 is a view taken along line 6—6 of FIG. 3.

As best depicted in FIG. 5, the carrier paper 16, extending upwardly from the tractor units 24, passes rearwardly over the separator shaft 66, under the guide finger shaft 68 and rearwardly through the nip defined between the two roller shafts 62 and 64. Behind the separator unit, the paper is supported by a grid of wires or bars 65 as it slides rearwardly across the printer housing and then falls into an appropriate receptacle. The external diameter of the roller shafts sleeves 72, their spacing and the durometer of the resilient sleeves or coatings are such that the paper is gripped firmly in the roller nip but can nevertheless slip somewhat so that the web is maintained in tension between the roller shafts and the tractor units without being damaged. If desired, spring loaded means can be employed to allow adjustment of the nip pressure exerted on the paper by the roller shafts, but this does not appear to be necessary unless carrier paper of different thicknesses or different frictional characteristics are to be used.

As the carrier paper is pulled rearwardly around the upper surface of the separator shaft, the stiffness of the adjacent card 18 is sufficient to overcome the releasable adhesive by which the card is attached to the carrier sheet. Consequently, the card continues to move upwardly into contact with arcuate guide fingers 84 carried by shaft 68 as shown at numeral **18*a* in FIG. 5. These guide fingers direct the leading edge of the card forwardly over box-like receptacle 28, which is mounted in a cut-away region of window 14 and supported to the window by an angle bracket 86. By the time the card is completely separated from the carrier sheet, it is located above the receptacle as shown at numeral 18*b* and thereafter drops into the receptacle as illustrated at numeral 18*c*. Each successive card likewise falls into the receptacle, printed face down, atop the previous card. After the stack of cards is removed, which is facilitated by pivoting the guide fingers rearwardly as shown in FIG. 2**, the stack is inverted so that the cards are then in the same sequential order in which they were printed.

The illustrated receptacle 28 is narrower than the maximum width of paper that can be accommodated by the tractor units, because the illustrative embodiment is designed to print only standard width cards, notwithstanding the fact that the separator unit is wide enough to allow the printer to be used to print wider strips of conventional continuous-form paper. Obviously, if cards were provided on a wider carrier strip, for example if two sets of cards were carried side by side on such a strip, the receptacle could be made correspondingly wider.

To thread the paper through the printer, regardless of whether conventional continuous-form paper or similar card carrier paper is used, the tractor units are hinged open and the leading end of the paper is fed over the separator shaft, below the guide finger shaft and into the roller shaft nip, while the drive mechanism is actuated to drive the roller shafts. When the paper has emerged from the back side of the separator unit and most of the slack has been eliminated below the separator unit, the paper margins are engaged with the tractor belt teeth and the tractor units are closed. Thereafter, the machine is run long enough for the paper to be drawn tight between the separator unit and the tractor units to complete the threading operation. To simplify the threading operation when conventional continuous-form paper is being used, the separator unit 26 might be spaced from the support plate 36 to allow such conventional paper to pass below and behind the separator unit rather then through that unit.

The two roller shafts and the separator shaft all rotate with the same angular velocity in the illustrative embodiment but the separator shaft is of somewhat smaller diameter than the roller shafts. Consequently, the separator shaft imposes some frictional drag on the paper carrier sheet, but much less than would a non-rotatable shaft. This can obviously be eliminated by making the separator shaft the same diameter as the roller shafts or by making the pulleys and gear on the separator shaft smaller than the pulleys and gears on the roller shafts, but the very successful operation of the illustrative embodiment indicates that this is not necessary. Alternatively, the separator shaft could rotate freely rather than being power driven or a fixed bar might be used, although the latter would not appear to be advisable. Similarly, only one of the two roller shafts might be power driven the other being simply free to rotate on its bearings. In other words, in its simplest embodiment only one of the roller shafts would be power driven and the other roller shaft and the separator bar would rotate freely, but positively driving all three shafts has been shown to improve the performance and reliability of the unit. Rather than employing rollers as the paper driving device in the separator unit, that function could be performed by tractor units similar to units 24, in which case all of the tractor units would be synchronized to drive the paper at the same speed.

From the foregoing description it will be apparent that the card separator device according to the present invention is simple and relatively inexpensive, can be added to an existing printer without major modification of the printer and permits the printer to still be used in its conventional mode of operation.

The invention has been described with reference to illustrative preferred embodiments but variations and modifications are possible within the spirit and scope of the invention as defined by the following claims.

I claim:

1. A card separator means for adapting an electronic printer including tractor means driven by a rotational power driven shaft for pulling a strip of marginally perforated continuous-form paper upwardly past a printing unit to allow said printer to print on the front faces of cards separably mounted to a carrier strip corresponding to said strip of continuous-form paper, said card separator means comprising:

(a) a separator shaft located above said tractor means;

(b) paper driving means located rearwardly of said separator shaft to pull said carrier strip partially around said separator shaft to thereby separate said strip from a card being moved past said separator shaft by said carrier strip;

(c) guide finger means engageable by said card during its separation from said carrier strip to deflect said card forwardly; and (d) receptacle means below said guide finger means for receiving successive cards separated from said carrier strip, with said cards being oriented in said receptacle means in stacked relation with their printed front faces directed downwardly.

2. The invention defined by claim 1 in which said paper driving means derives power from said power driven shaft to drive said paper driving means in synchronism with said tractor means.

3. The invention defined by claim 2 in which said paper driving means comprises a pair of roller shafts defining a paper driving nip therebetween.

4. The invention defined by claim 3 in which both of said roller shafts are power driven in opposite directions to feed paper through the nip therebetween.

5. The invention defined by claim 2 in which said separator shaft is power driven from said power driven shaft to rotate said separator shaft in a paper feeding direction.

6. The invention defined by claim 1 in which said guide finger means is movable between an operative position in which said guide finger means guides cards separated from said carrier strip into said receptacle means and a threading position which permits access to said shafts during threading of paper through said separator means.

* * * * *